US005388906A

United States Patent [19]

Rao

[11] Patent Number: 5,388,906

[45] Date of Patent: Feb. 14, 1995

[54] STATIC MIXER FOR TWO OR MORE FLUIDS

[75] Inventor: Sundar M. Rao, Seaford, Del.

[73] Assignee: E. I. Du Pont de Nemours and Company, Wilmington, Del.

[21] Appl. No.: 809,841

[22] Filed: Dec. 18, 1991

[51] Int. Cl.[6] ..... B01F 5/04; B01F 5/06

[52] U.S. Cl. ..... 366/173; 366/336; 366/340; 239/424.5; 264/50

[58] Field of Search ..... 366/336–340, 366/150, 167, 173, 174, 176, 177; 425/130, 197, 4 R, 4 C, 817 R; 264/45.9, 50; 239/429, 430, 424.5; 137/3, 4, 896

[56] References Cited

U.S. PATENT DOCUMENTS

| | | | |
|---|---|---|---|
| 3,376,023 | 4/1968 | Lage | 366/174 |
| 3,413,387 | 11/1968 | Ohsol | 264/45.9 |
| 3,749,377 | 7/1973 | Slater et al. | 261/78 R |
| 3,972,970 | 8/1976 | Taylor | 264/45.9 |
| 4,002,297 | 1/1977 | Pillard | 239/429 |
| 4,033,710 | 7/1977 | Hanning | 425/817 R |
| 4,054,619 | 10/1977 | Coverston | 261/24 |
| 4,808,007 | 2/1989 | King | 366/337 |
| 4,812,049 | 3/1989 | McCall | 261/76 |

FOREIGN PATENT DOCUMENTS

| | | | |
|---|---|---|---|
| 935418 | 6/1948 | France | 366/174 |
| 402488 | 3/1943 | Italy | 239/430 |

*Primary Examiner*—Stephen F. Gerrity
*Assistant Examiner*—Randall E. Chin

[57] ABSTRACT

Distribution of a fluid additive through multiple passages across the cross section of a pipe carrying molten/fluid polymer wherein the polymer flow is distributed across the cross section of the pipe provides uniform distribution of the fluid additive when the passages are directed in the downstream direction of flow and substantially parallel to the longitudinal axis of the pipe carrying the polymer. This device is advantageous for mixing of two or more fluids independent of the viscosity differences.

2 Claims, 4 Drawing Sheets

STATIC MIXER FOR TWO OR MORE FLUIDS

The present invention relates to a mixer for two or more fluids and more particularly it relates to a static mixer for distributing additive fluids at locations over the cross section of a pipe carrying another fluid of different viscosity.

The uniform distribution and dispersion of an additive into a polymer stream flowing through a pipe under laminar flow conditions is a difficult task. A variety of approaches have been disclosed for this task such as:

(a) distributing/dispersing of the additive into polymer under laminar flow conditions (due to high viscosity and low velocity of the polymer) by injecting the additive at the wall of the pipe and using inline static mixers to mix the additive into the molten polymer stream;

(b) injecting the additive directly at the center of the pipe and mixing with polymer using inline static mixers;

(c) using a flow inverter downstream of the injection point to bring the wall injected additive to the center and then mixing with the polymer using inline static mixers.

The commercially available inline static mixers can disperse and distribute the additive only at the cost of a very high pressure drop. This pressure drop, which is energy dissipated into the polymer, results in temperature increase of the polymer, causing degradation and poor quality of the final product.

The present invention deals with a flow distributor that provides a positive distribution of the additive in multiple streams/droplets, across the cross section of a pipe carrying molten/liquid polymers. Using the exiting stream from this distributor as the feed stream to commercially available inline static mixers, the mixing of low viscosity/high viscosity additives to polymer streams can be accomplished at a much lower combined pressure drop compared to the processes described above.

SUMMARY OF THE INVENTION

A mixer for two or more fluids that includes an elongated substantially hollow tubular member having a longitudinal axis in which multiple flow passages are made available for the main polymer flow as well as for the additive streams. The mixing zone has at least two orifices for carrying the additive fluid and two or more orifices for the flow of the main polymer. The orifices have substantially circular cross sections and longitudinal axes which are substantially parallel to the longitudinal axis of the substantially hollow tubular member. A fluid entry port is provided for discharging a second fluid in the mixing zone. An array of passages are connected to the fluid entry port. The passages are distributed within said mixing zone, and have one end connected to the fluid entry port and their other end directed substantially parallel to the longitudinal axis of the substantially hollow tubular member.

DETAILED DESCRIPTION OF THE PREFERRED EMBODIMENT

Figure 1:
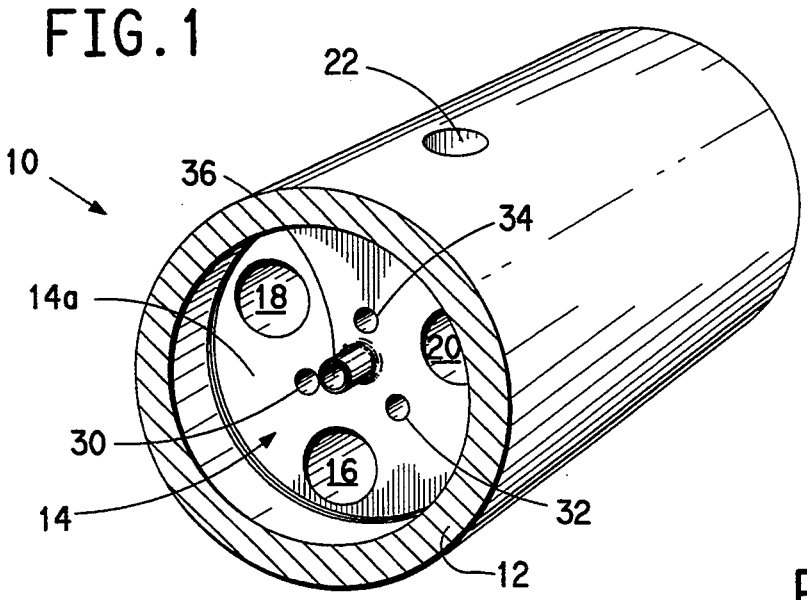
FIG. 1 is a perspective view of one embodiment of the invention.
Figure 2:
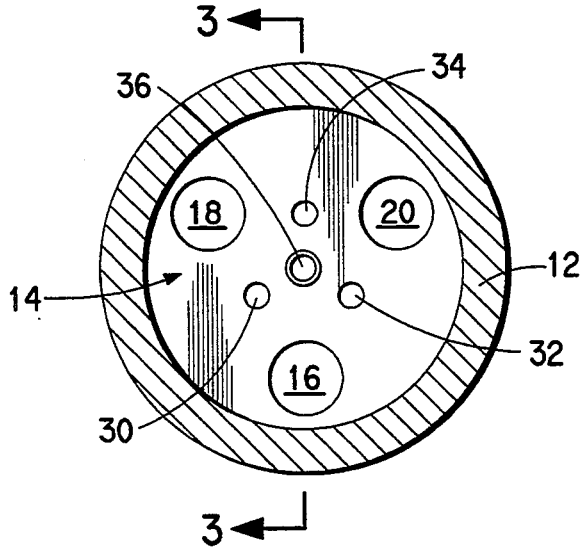
FIG. 2 is an end view of FIG. 1.
Figure 3:
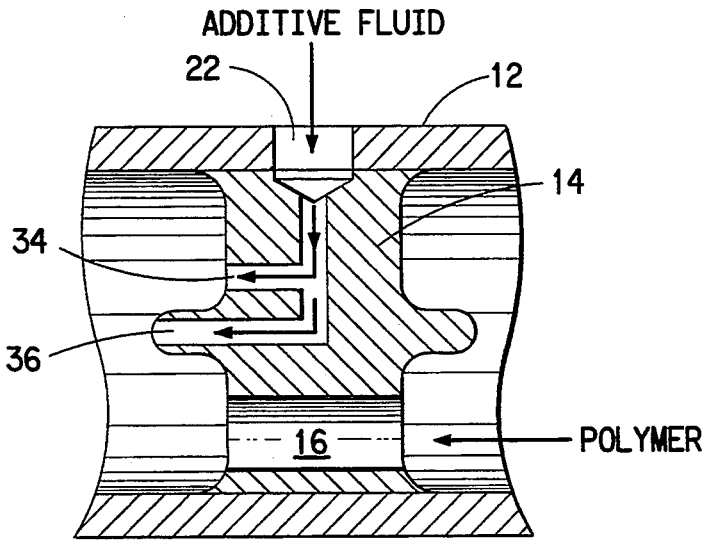
FIG. 3 is a side elevation cross sectioned view of FIG. 2 taken along line 3—3.

Referring now to FIG. 1 the mixer 10 includes a pipe 12 which is constricted by a mixing zone i.e., static mixer designated 14. The mixing zone 14 is a plate **14*a* having substantially circular orifices 16, 18 and 20 for the passage of molten polymer. Orifices 16, 18 and 20 have longitudinal axes which are substantially parallel to the longitudinal axis of the pipe 12. A fluid entry port 22 extends radially through the wall of pipe 12. An array of passages 30, 32, 34, and 36 are distributed within the mixing zone and connected to fluid entry port 22 at one end while the other ends of these passages are directed substantially parallel to the longitudinal axis of pipe 12 in the downstream direction of the polymer flow in pipe 12**.

Figure 4:
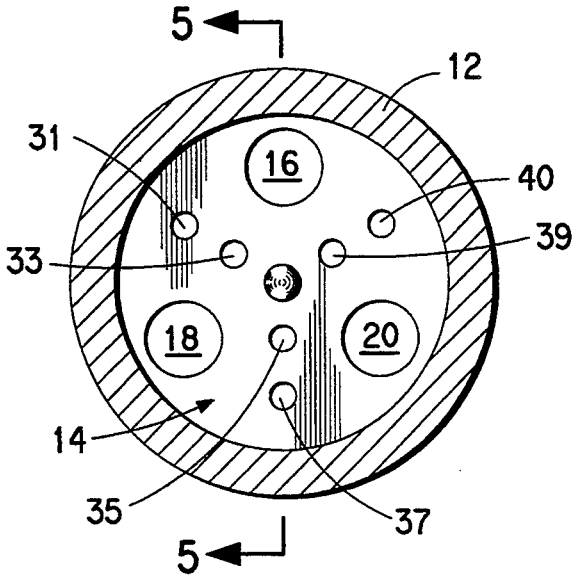
FIG. 4 is an end view of another embodiment the invention.
Figure 5:
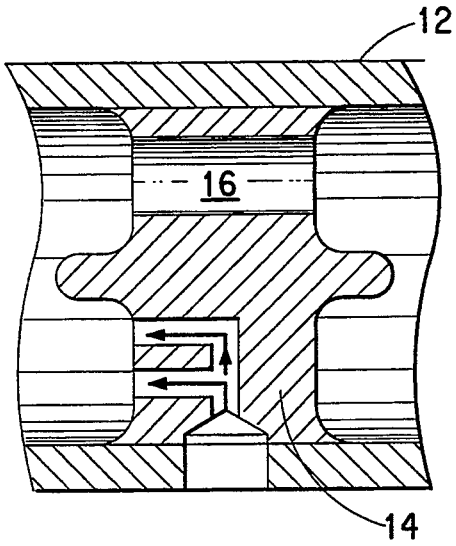
FIG. 5 is a side elevation cross sectional view of FIG. 4 taken along line 5—5.

FIGS. 4 and 5 depict a preferred embodiment with six additive passages 31, 33, 35, 37, 39 and 40 and three polymer orifices 16, 18 and 20.

Figure 6:
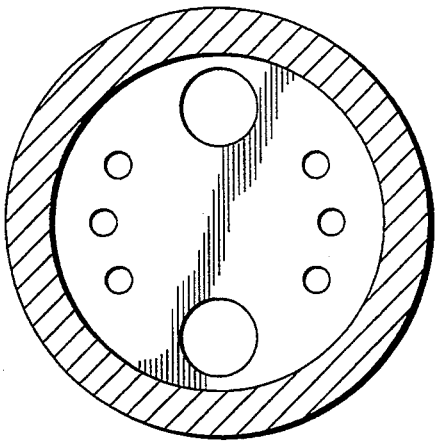
FIGS. 6–12 are end views of various embodiments of the present invention.
Figure 7:
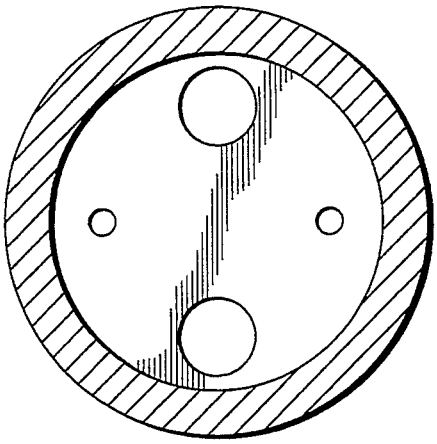
Figure 8:
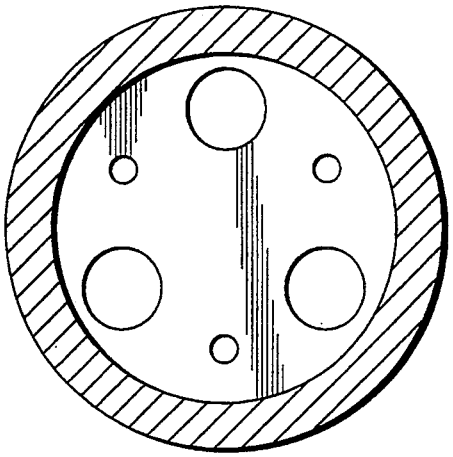
Figure 9:
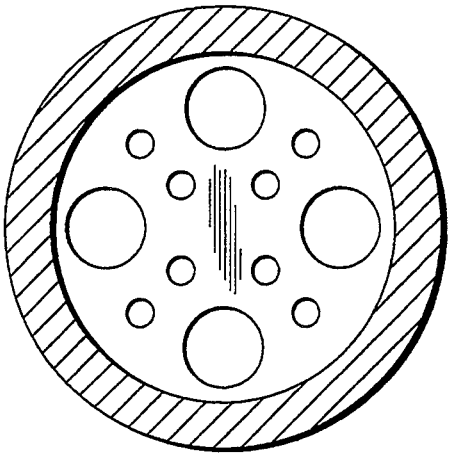
Figure 10:
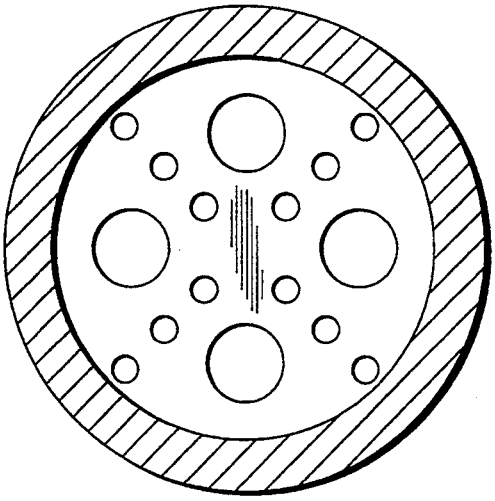
Figure 11:
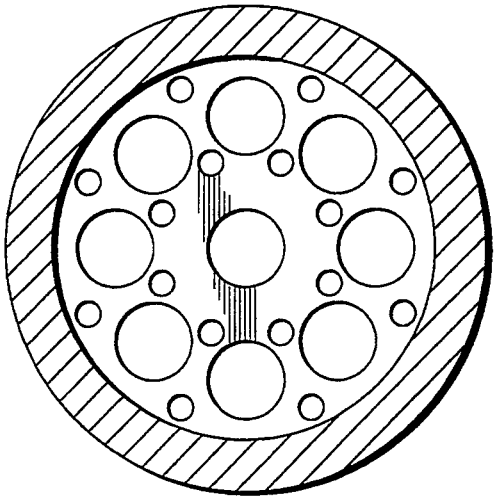

FIGS. 6–11 show alternative embodiments of polymer orifice and fluid additive passage arrangements that may be used. In each case, the fluid additive passages are smaller than the polymer orifices. More particularly, FIG. 6 shows a two polymer hole-6 additive hole arrangement. FIG. 7 shows a two polymer hole-2 additive hole arrangement. FIG. 8 shows a three polymer hole-3 additive hole arrangement. FIG. 9 shows a four polymer hole-8 additive hole arrangement. FIG. 10 shows a four polymer hole-12 additive hole arrangement. FIG. 11 shows a nine polymer hole-16 additive hole arrangement.

Figure 12:
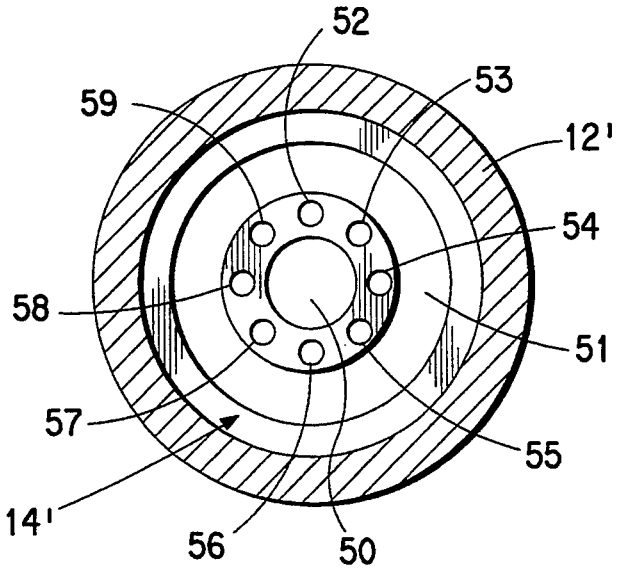

FIG. 12 shows an arrangement with a center polymer orifice 50 and an annular polymer orifice 51 along with 8 additive holes 52–59 arranged in an array concentric with and between the orifices.

These patterns of orifices and passages are only indicative of the possibilities using this concept (multiple holes for the additive, multiple holes for the polymer and symmetric distribution of the additive and polymer holes across the cross section in each quadrant). As an extension of this concept, one can also propose a very random pattern of numerous polymer holes and additive holes so that in each quadrant, there are equal flow rates of polymer and additive.

Since the additive is added in quantities of 0.5% to 10%, the additive passages are much smaller in diameter than polymer orifices. The distribution and size of the additive passages and that of the polymer orifices is such that flow rates through cross sections of the additive passages and polymer orifices are approximately the same in at least each quadrant. The size of the polymer orifices will depend on the pressure drop that can be allowed, the flow rate of the polymer etc., and will be based on standard design procedures. The design will also ensure there is no stagnation of the polymer as it enters or exits the mixing zone 14. The size of the additive passages away from the center will be larger than those close to the center, if the main feed passage for the additive is feeding the various additive holes from the center. This is to make sure that the flow rate of the additive through each additive passage is approximately the same. Standard design equations, well known in the art, can be used to size these holes.

The viscosity ratio is not important in this case as the additive will be forced out across the cross section of the pipe in multiple streams independent of viscosity. By providing very small diameter additive passages, we can help break up the additive droplets into much finer droplets, thereby improving dispersion. This device enhances dispersion and distribution of the additive in the polymer. This device should perform well if additive viscosity is higher or lower than the polymer viscosity or even identical to the polymer viscosity. We can also contemplate increasing the number of additives by increasing the number of individual passages dedicated to individual additives and substantially maintaining equal distribution of each additive in each quadrant of the pipe.

I claim:

1. In a mixer for one or more additive fluids and a molten polymer that includes an elongated pipe having a longitudinal axis in which said pipe is constricted intermediate opposite ends of the pipe with a flow distributor, said flow distributor having at least two orifices for carrying said polymer moving through said pipe, said orifices having substantially circular cross sections and having longitudinal axes which are substantially parallel to the longitudinal axis of the pipe and a fluid entry port for discharging said additives into said flow distributor, the improvement comprising: an array of passages connected to said fluid entry port, said passages being distributed within said flow distributor, said passages having one end connected to said fluid entry port and their other end directed substantially parallel to the longitudinal axis in a downstream direction of the flow through the pipe, each of said passages having circular cross section with a diameter less than the diameter of any one of said orifices.

2. The mixer as defined in claim 1 wherein there are two orifices, one orifice being concentric with and spaced from the other, said passages being in an array concentric with and between said orifices.

* * * * *